US005522325A

United States Patent [19]

Knauer

[11] Patent Number: 5,522,325

[45] Date of Patent: Jun. 4, 1996

[54] HOLLOW METAL PROFILE AND METAL PALLET MANUFACTURED THEREFROM

[75] Inventor: Gerhard Knauer, Bremen, Germany

[73] Assignee: Kastens & Knauer GmbH & Co. KG, Lilienthal/Bremen, Germany

[21] Appl. No.: 272,028

[22] Filed: Jul. 8, 1994

[30] Foreign Application Priority Data

Jul. 14, 1993 [DE] Germany ..... 9310513 U

[51] Int. Cl.[6] ..... B65D 19/00

[52] U.S. Cl. ..... 108/51.1; 108/56.1; 52/660

[58] Field of Search ..... 108/51.1, 56.1; 52/656.5, 456, 665, 669, 660, 656.1, 656.2, 656.3, 656.4, 656.6, 656.7, 720, 732.1, 732.2, 731.7, 731.5, 731.4, 731.3, 731.2, 731.1, 730.6, 730.5, 730.4, 730.3

[56] References Cited

U.S. PATENT DOCUMENTS

| | | | |
|---|---|---|---|
| 2,700,441 | 1/1955 | Cudini | 52/730.6 X |
| 3,475,870 | 11/1969 | Birum, Jr. | 52/656.2 X |
| 3,633,861 | 1/1972 | Hillenbrand | 108/56.1 X |
| 3,899,857 | 8/1975 | Mochizuki | 52/665 X |
| 4,100,709 | 7/1978 | Good | 52/656.1 X |
| 4,497,260 | 2/1985 | Bucher | 108/56.1 |
| 4,597,339 | 7/1986 | McCaffrey et al. | 108/51.1 |
| 4,809,476 | 3/1989 | Satchell | 52/730.4 X |
| 4,831,804 | 5/1989 | Sayer | 52/656.5 X |
| 5,069,143 | 12/1991 | Bunger | 108/51.1 |
| 5,157,883 | 10/1992 | Meyer | 52/720 X |

FOREIGN PATENT DOCUMENTS

| | | | |
|---|---|---|---|
| 2378971 | 9/1978 | France | 52/656.4 |
| 2476605 | 8/1981 | France | 108/51.1 |
| 2111135 | 9/1972 | Germany | 108/56.1 |

*Primary Examiner*—Peter M. Cuomo
*Assistant Examiner*—Janet M. Wilkens
*Attorney, Agent, or Firm*—Merchant, Gould, Smith, Edell, Welter & Schmidt

[57] ABSTRACT

Hollow metal profile having a substantially U-shaped cross-section includes a supporting wall, to which is connected a first side wall and a second side wall substantially at right angles thereto. The first side wall forms in its central area a U-shaped part extending parallel to the supporting wall in a direction of the second side wall. The side walls, in each case equidistantly of the supporting wall, pass into first and second reinforcing walls directed towards one another and parallel to the supporting wall. Portions of the supporting wall and the second reinforcing wall which is connected to the second side wall each carries a fixing lug directed towards one another and which, together with the second side wall define two U-shaped recesses.

15 Claims, 2 Drawing Sheets

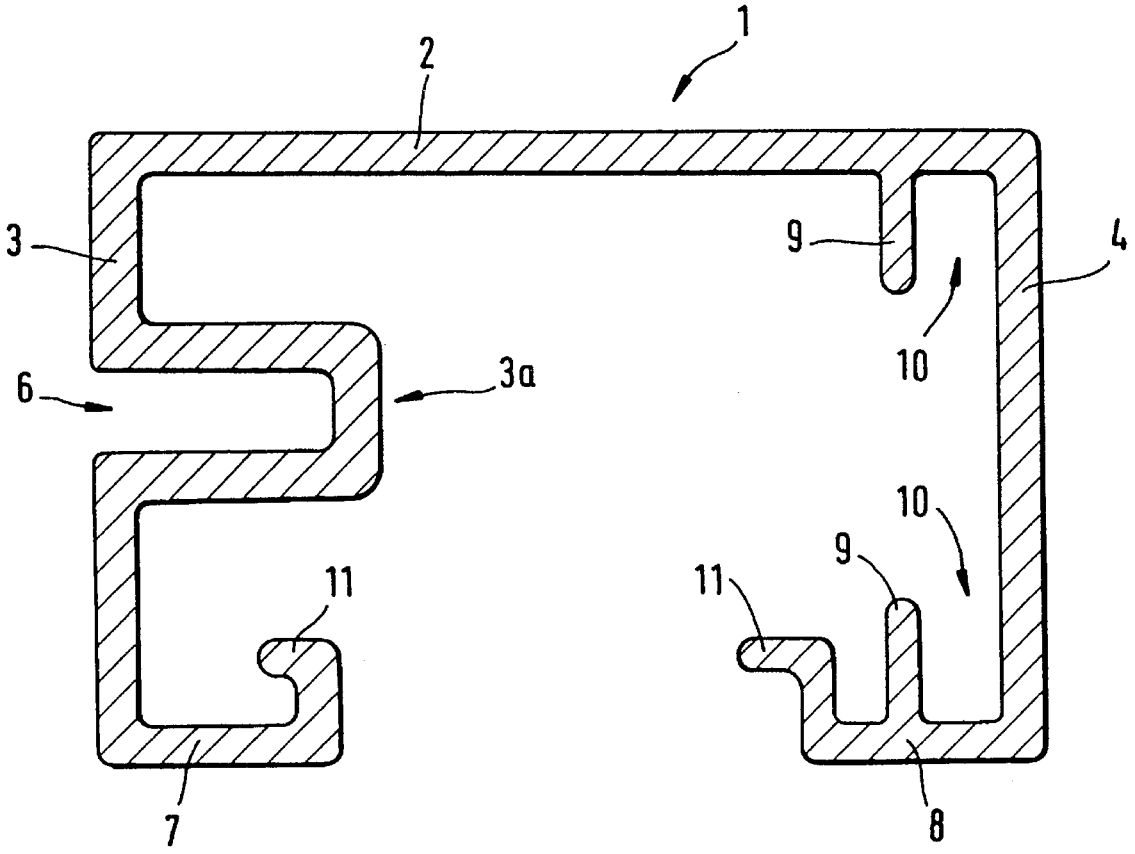
Fig. 1
Fig. 2
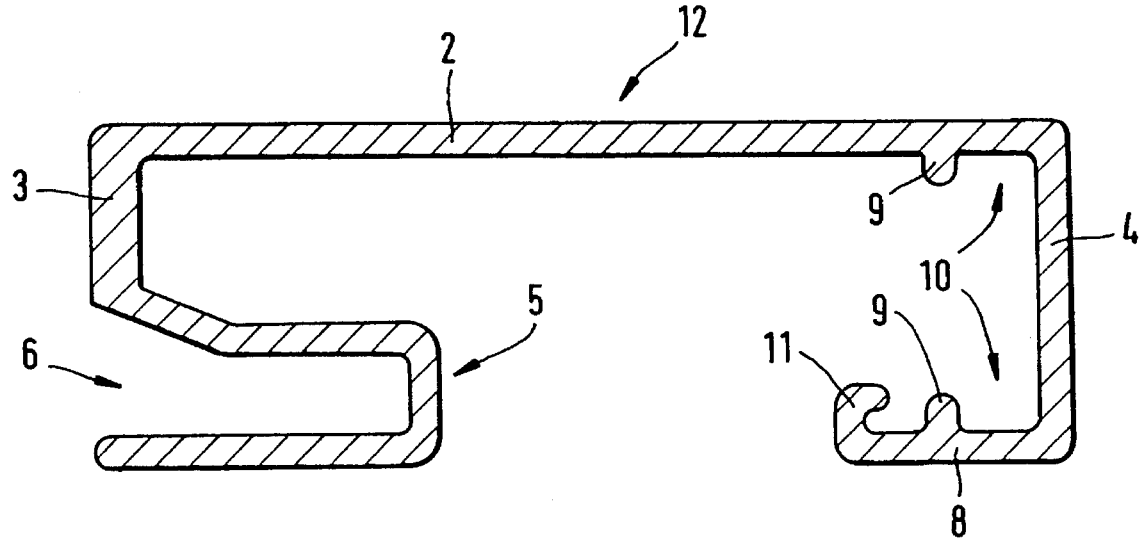

HOLLOW METAL PROFILE AND METAL PALLET MANUFACTURED THEREFROM

BACKGROUND OF THE INVENTION

The invention relates to a transportation pallet with at least two longitudinal members and at least two transverse members perpendicular thereto and terminally connected thereto.

In particular for the manufacture of pallets, the invention relates to a hollow metal profile, whose cross-section is substantially U-shaped and has an upper supporting wall, to which a first side wall is connected to a first (left) side and a second side wall is connected to a second (right) side substantially at right angles.

Pallets are used to a great extent throughout the world for the transportation and storage in particular of stackable piece goods. They are essentially used for facilitating the handlability of piece goods, e.g. by means of fork lifts in that a spacing is created between the stack of piece goods and the ground which permits raising to take place. Pallets are manufactured in numerous different sizes and are conventionally formed from wooden parts in the form of planks and blocks, which are joined together by clips or nails.

The known wooden pallets suffer from a number of disadvantages. As a result of the significant stressing in use, e.g. through being struck by fork lifts, pieces of wood easily break off, so that the pallet stability is impaired. Even slight damage leads to the formation of wood splinters, which can make handling by workers dangerous. In addition, conventional wooden pallets have a significant weight, so that there are considerable extra freight charges for numerous uses. Particularly in the case of air freight or overseas dispatches costs are increased by the fact that pallets of a conventional nature are not generally returned, because the transportation costs would exceed the manufacturing costs.

Moreover pallets which are frequently damaged on the way to the recipient are usually destroyed at the destination, which is highly prejudicial to the environment.

SUMMARY OF THE INVENTION

The object of the present invention is to obviate these and further disadvantages and to create a pallet which can be used a number of times, saves weight, can be easily manufactured and in the case of damage can readily be repaired.

According to the invention this problem is solved in that the longitudinal and transverse members of a pallet are made from hollow metal profiles. Advantageous developments of the invention are described hereinafter.

Another problem of the invention is to provide a hollow metal profile, which is more particularly suitable for the manufacture of pallets, which is able to absorb the loads occurring in use with a minimum damage risk and which can be manufactured easily in a weight and cost-favourable manner.

According to the invention this problem is solved in that in the case of a hollow metal profile of the aforementioned type the first side wall forms in its central area an outwardly open, U-shaped part extending towards the second side wall parallel to the supporting wall, that the side walls, equidistantly of one another, pass into first and second reinforcing walls directed towards one another and parallel to the supporting wall and that the portions of the supporting wall and the second reinforcing wall connected to the second side wall carry inwardly directed fixing lugs, which-together with the second side wall define two U-shaped recesses.

An advantageous further development of the hollow metal profile according to the invention con, rises the reinforcing walls carrying on their opposite end portions in each case one I or L-shaped projection directed towards the supporting wall.

Another advantageous embodiment is characterized in that in the case of a hollow metal profile of the aforementioned type the first side wall on its end portion directed way from the supporting wall defines an outwardly open, U-shaped Dart extending in the direction of the second side wall, that the second side wall passes into a reinforcing wall extending parallel to the supporting wall and whose distance from the latter is substantially the same as that of the portion of the part remote from the supporting wall and that the portions of the supporting wall and the second reinforcing wall connected to the second side wall carry fixing lugs directed towards one another, which together with the second side wall define two U-shaped recesses.

An appropriate development of this embodiment comprises the end of the end portion of the reinforcing wall carrying an I or L-shaped projection directed towards the supporting wall.

Advantageously in both embodiments the wall thicknesses of the supporting, side and reinforcing walls, the fixing lugs and optionally the projections are substantially the same.

In an advantageous embodiment the hollow metal profiles are made from aluminium extrusion.

A preferred embodiment of the pallets no be manufactured from the hollow metal profiles according to the invention comprises both the longitudinal and transverse members of the pallets being constituted by hollow metal profiles according to the first embodiment.

In another embodiment of the pallet according to the invention the (additional) transverse members positioned between the two outer transverse members are hollow metal profiles according to the second embodiment.

In another embodiment of the pallet the longitudinal and transverse members comprise hollow metal profiles according to the second embodiment.

Appropriately the longitudinal and transvers members are in each case welded together.

Advantageously there is a corner wedge in the U-shaped recesses of the longitudinal members and the two outer transverse members of a pallet.

A preferred embodiment has a flat part in the U-shaped recess of one of the longitudinal members and in one (each) transverse member connected thereto positioned between the two outer transverse members at the junction points thereof.

In a particularly preferred embodiment the pallet has two outer and five further transverse members.

BRIEF DESCRIPTION OF THE DRAWINGS

The invention is described in greater detail hereinafter relative to a non-limitative embodiment and the attached drawings, wherein show:

FIG. 1 A first embodiment of the hollow metal profile according to the invention in cross-section.

FIG. 2 A second embodiment of a hollow metal profile according to the invention in cross-section.

DETAILED DESCRIPTION OF THE PREFERRED EMBODIMENT

Figure 3:
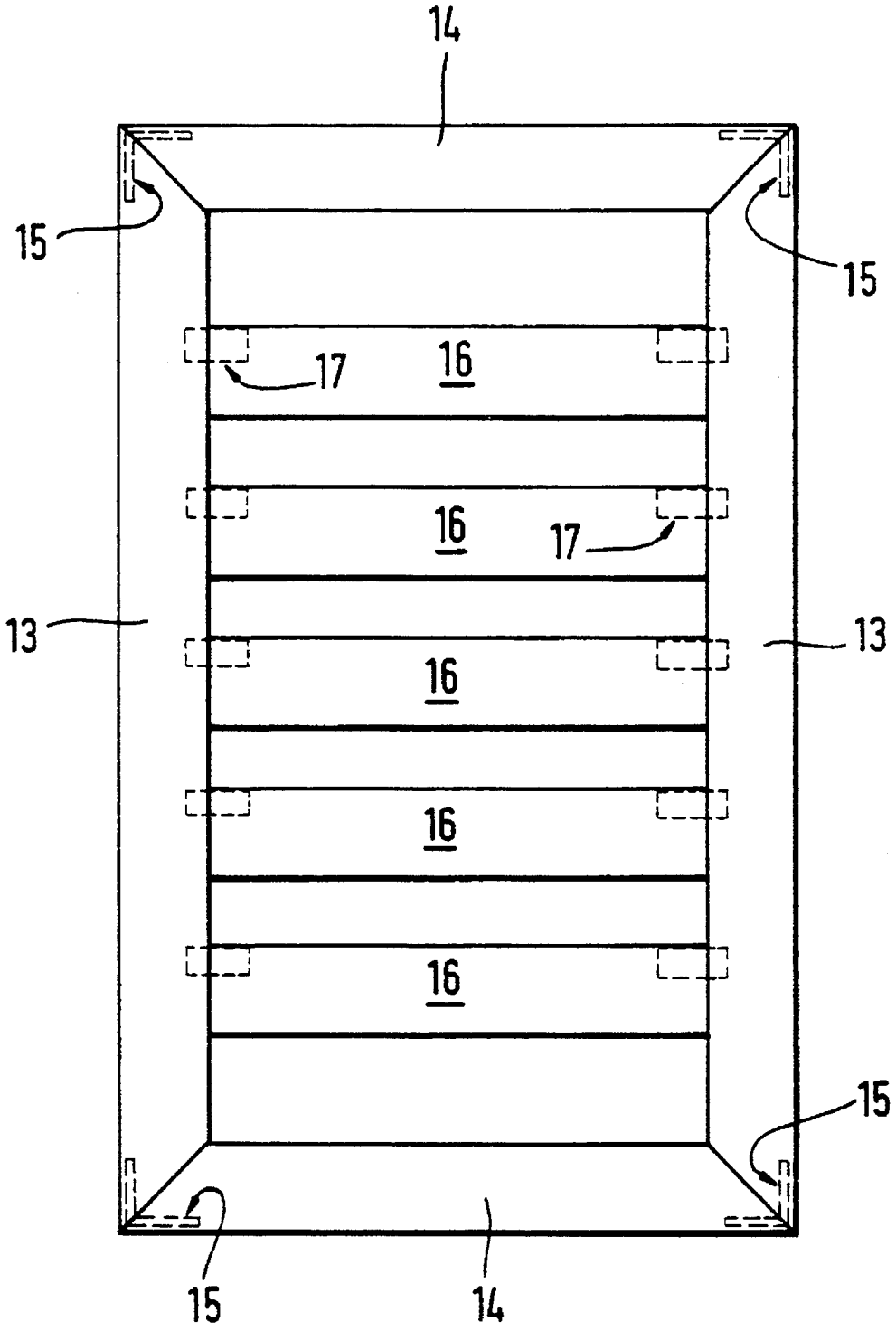
FIG. 3 Diagrammatically the construction of a pallet according to the invention in plan view.

FIG. 1 shows a hollow metal profile 1 having substantially a U-shaped cross-section with an upper supporting wall 2, a first side wall 3 and a second side wall 4. In its central area the first side wall 3 forms a part 3*a* projecting into the interior of the profile 1, so that an outwardly open recess 6 is defined. Below the part 6 the side wall 3 continues and passed into a first reinforcing wall 7 parallel to the supporting wall 2. As shown in FIG. 1, the supporting wall 2 is a flat wall.

The second side wall 4 also passes into a second reinforcing wall 8. The supporting wall 2 and the reinforcing wall 8 carry in spaced manner with respect to the second side wall 4 dependent fixing lugs 9 which, together with the second side wall 4, define two U-shaped recesses 10. The facing reinforcing walls 7, 8 carry on their end portions in each case a L-shaped projection 11.

A second embodiment of the hollow metal profile according to the invention is shown in FIG. 2. The profile 12 also has a supporting wall 2, a first side wall 3 with a U-shaped part 5 and a corresponding recess 6, a second side wall 4, a second reinforcing wall 8 and fixing lugs 9 and corresponding U-shaped recesses 10. The essential difference between the two embodiments of FIGS. 1 and 2 is that the profile 12 is flatter, thinner and therefore lighter than the profile 1, which permits the construction of lighter pallets with a reduced load bearing capacity.

With reference to FIG. 3 a description will now be given of the construction of a pallet according to the invention. For the manufacture of the pallet firstly the longitudinal members 13 and the terminal transverse members 14 are cut to length from the hollow metal profile 1 according to the invention, mitre cut and than assembled to form a rectangular frame. In the recesses 10 of the frontally abutting longitudinal and transverse members in each corner of the pallet is inserted a wedge 15, which is used for fixing the reciprocal position of the members prior to welding and for increasing the strength. In order to increase the torsional stiffness of the pallet, between the transverse members 14 are inserted further transverse members 16, which are manufactured from the hollow metal profile 12 (FIG. 2) according to the invention and are fixed in position with flat parts 17 for facilitating assembly and increasing strength. Here again the final joining of the transverse members 16 to the longitudinal members 13 appropriately takes place by welding.

To complete the pallet the latter is provided in its corner points, i.e. under the junctions of the longitudinal and transverse members 13 and 14, with in each case a not shown corner post. As a function of the length and loading of the pallet it is also possible to provide further posts, e.g. in the centre of the longitudinal members 13. The corner and optionally central posts are used for giving the pallet frame the necessary distance from the ground, so that e.g. the forks of a fork lift can pass under it and can therefore be made from a random, adequately pressure-resistant and appropriately shock-absorbing material.

The function of the L-shaped projections 11 is to prevent the normally somewhat upwardly directed forks of a fork lift penetrating a hollow profile in the case of an inaccurate approach of a pallet and thereby damaging the same.

I claim:

1. Hollow metal profile having a substantially U-shaped cross-section, comprising:

a supporting wall, to which is connected a first side wall and a second side wall substantially at right angles thereto, the supporting wall entirely being a flat wall;

wherein the first side wall forms in its central area a U-shaped part extending parallel to the supporting wall in a direction of the second side wall;

wherein the side walls, in each case equidistantly of the supporting wall, pass into first and second reinforcing walls directed towards one another and parallel to the supporting wall; and wherein portions of the supporting wall and the second reinforcing wall which is connected to the second side wall each carries a dependent fixing lug directed towards one another and which, together with the second side wall define two U-shaped recesses.

2. Hollow metal profile according to claim 1, wherein a facing end portion of each of the first and second reinforcing walls carries a L-shaped projection directed towards the supporting wall.

3. Hollow metal profile having a substantially U-shaped cross-section, comprising:

a supporting wall, to which is connected a first side wall and a second side wall substantially at right angles thereto;

wherein the first side wall on an end portion directed away from the supporting wall forms a U-shaped part extending parallel to the supporting wall in a direction of the second side wall;

wherein the second side wall passes into a reinforcing wall running parallel to the supporting wall and whose distance from the supporting wall is substantially as large as that of a portion of the U-shaped part remote from the supporting wall; and wherein portions of the supporting wall and the reinforcing wall which is connected to the second side wall each carries a fixing lug directed towards one another and which, together with the second side wall, define two U-shaped recesses.

4. Hollow metal profile according to claim 3, wherein a free end portion of the reinforcing wall carries a L-shaped projection directed towards the supporting wall.

5. Hollow metal profile according to claim 4, wherein wall thicknesses of the supporting wall, the side walls, the first and second reinforcing wall, the fixing lugs, and the projection are substantially the same.

6. Hollow metal profile according to claim 5, wherein the profile is made from aluminum.

7. Hollow metal profile according to claim 6, wherein the profile is manufactured by extrusion.

8. Hollow metal profile according to claim 3, wherein the supporting wall is a flat wall.

9. Transportation pallet, comprising:

at least two longitudinal members and at least two transverse members terminally connected thereto and at right angles thereto;

wherein each of the longitudinal members and transverse members comprises a hollow metal profile which has a substantially U-shaped cross-section; and the hollow metal profile, comprising:

a supporting wall, to which is connected a first side wall and a second side wall substantially at right angles thereto;

wherein the first side wall forms in its central area a U-shaped part extending parallel to the supporting wall in a direction of the second side wall;

wherein the side walls, in each case equidistantly of the supporting wall, pass into first and second reinforcing walls directed towards one another and parallel to the supporting wall; and wherein portions of the supporting wall and the second reinforcing wall which is connected to the second side wall each carries a fixing lug directed towards one another and which, together with the second side wall define two U-shaped recesses.

10. Pallet according to claim 9, wherein the transverse members include a plurality of inner transverse members and two outer transverse members, the inner transverse members being located between the two outer transverse members.

11. Transportation pallet, comprising:

at least two longitudinal members and at least two transverse members terminally connected thereto and at right angles thereto;

wherein each of the longitudinal members and transverse members comprises a hollow metal profile which has a substantially U-shaped cross-section; and the hollow metal profile, comprising:

a supporting wall, to which is connected a first side wall and a second side wall substantially at right angles thereto;

wherein the first side wall on an end portion directed away from the supporting wall forms a U-shaped part extending parallel to the supporting wall in a direction of the second side wall;

wherein the second side wall passes into a reinforcing wall running parallel to the supporting wall and whose distance from the supporting wall is substantially as large as that of a portion of the U-shaped part remote from the supporting wall; and wherein portions of the supporting wall and the reinforcing wall which is connected to the second side wall each carries a fixing lug directed towards one another and which, together with the second side wall, define two U-shaped recesses.

12. Pallet according to claim 11, wherein the longitudinal members and the transverse members are in each case welded together.

13. A pallet according to claim 12, wherein the transverse members include at least two outer transverse members, in each case one wedge (15) is disposed in the U-shaped recesses of the longitudinal members and the outer transverse members.

14. Pallet according to claim 12, wherein a flat part in a U-shaped part of one of the longitudinal members is connected to one of the transverse members at junction points thereof located between the two outer transverse members.

15. Pallet according to claim 12, wherein the transverse members include two outer transverse members and five inner transverse members.

* * * * *

UNITED STATES PATENT AND TRADEMARK OFFICE

CERTIFICATE OF CORRECTION

PATENT NO. : 5,522,325

DATED : 4 June 1996

INVENTOR(S) : Gerhard Knauer

It is certified that error appears in the above-identified patent and that said Letters Patent is hereby corrected as shown below:

Column 2, line 4, "con,rises" should be --comprises--.

Column 2, line 32, "no" should be --to--.

Column 4, line 44 (Claim 5), before "side" insert --first and second--, line 45, delete "first and second".

Column 6, line 15 (Claim 13), "A pallet" should be --Pallet--.

Signed and Sealed this

Seventeenth Day of December, 1996

*Attest:*

Bruce Lehman

BRUCE LEHMAN

*Attesting Officer*

*Commissioner of Patents and Trademarks*